US006273325B1

(12) United States Patent
Samurin

(10) Patent No.: US 6,273,325 B1
(45) Date of Patent: Aug. 14, 2001

(54) NOZZLE ASSEMBLY AND METHOD OF MANUFACTURING SAME

(75) Inventor: Norman A. Samurin, Allegany, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/157,865

(22) Filed: Sep. 21, 1998

(51) Int. Cl.[7] ..... B23K 35/02

(52) U.S. Cl. ..... 228/165; 228/169; 29/890.142; 138/171

(58) Field of Search ..... 228/165, 164, 228/169, 182; 29/890.142, 463; 138/156, 157, 171; 285/419

(56) References Cited

U.S. PATENT DOCUMENTS

| | | | | |
|---|---|---|---|---|
| 3,664,077 | * | 5/1972 | Arnold | 52/283 |
| 4,112,568 | | 9/1978 | Hale . | |
| 4,126,405 | | 11/1978 | Bobo et al. . | |
| 4,137,006 | | 1/1979 | Becker . | |
| 4,281,964 | | 8/1981 | Jinkins . | |
| 4,473,171 | * | 9/1984 | Nunlist | 220/465 |
| 4,596,637 | * | 6/1986 | Kozarek et al. | 204/67 |
| 5,012,853 | | 5/1991 | Bihlmaier . | |
| 5,015,817 | * | 5/1991 | Kranz | 219/121.14 |

OTHER PUBLICATIONS

Forging Design Handbook, Paul Unterweiser, 1972, pp. 126,127,183–185.*

Hartford Steam and Boiler Inspection and Insurance Co. Technical Data Handbook. pp. 68,69,112,113,130,131, (No date available).*

* cited by examiner

*Primary Examiner*—Tom Dunn
*Assistant Examiner*—Jonathan Johnson
(74) *Attorney, Agent, or Firm*—Haynes and Boone LLP

(57) ABSTRACT

A method of manufacturing a nozzle assembly and a nozzle formed thereby in which first and second body portions are formed and connected together to form an enclosure, and one end of the enclosure is connected to a flange assembly.

5 Claims, 2 Drawing Sheets

NOZZLE ASSEMBLY AND METHOD OF MANUFACTURING SAME

SUMMARY OF THE INVENTION

According to be present invention, the nozzle assembly is formed by a first and second body portion that are connected together to form an enclosure, one end of which is connected to a flange assembly.

A distinct advantage is gained by the method and nozzle assembly of the present invention since the nozzle assembly can be manufactured quickly and easily and is relatively inexpensive.

DESCRIPTION OF THE PREFERRED EMBODIMENT

Figure 1:
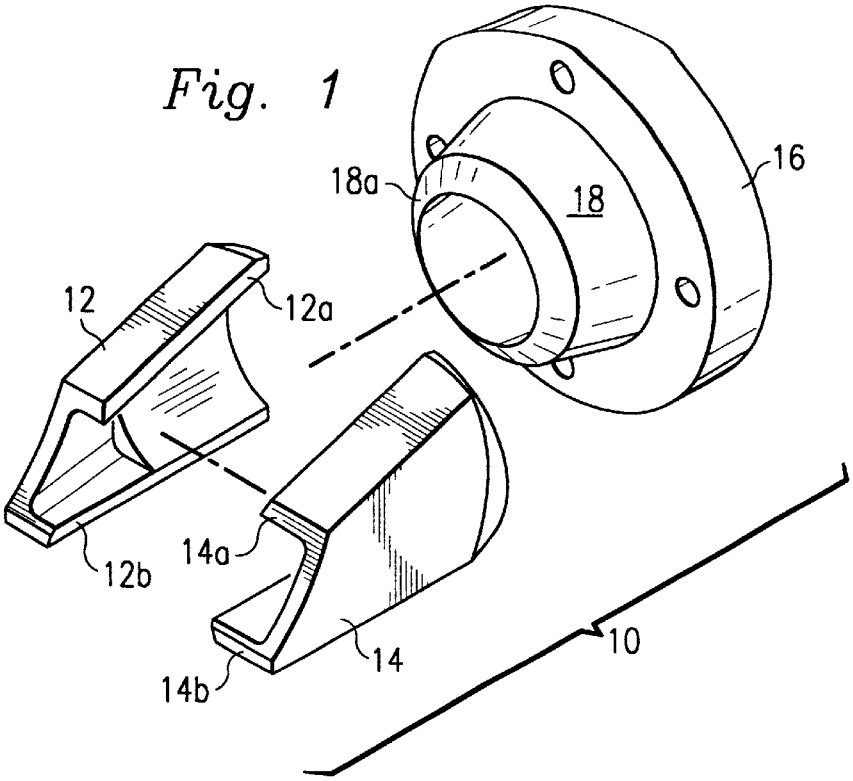
FIG. 1 is an exploded isometric view of the nozzle assembly of the present invention which is manufactured according to the method of the present invention.

Referring to FIG. 1 of the drawings, the reference numeral 10 refers, in general to the nozzle assembly of the present invention which comprises two body portions 12 and 14 which are similar, but not identical to each other. An annular neck flange 16 is provided which has a frusto-conical mounting member 18 extending from one end thereof which has a chamfered distal end 18*a*. The mounting member 18 can be formed integrally with the flange 16 or it can be connected to the flange in any known manner. The flange 16 and the member 18 are coaxially disposed and together define a through bore. The body portions 12 and 14, the flange 16, and the mounting member 18 can either be formed by forging or by a plate material in a conventional matter.

The body portion 12 is substantially U-shaped and has two parallel legs 12*a* and 12*b* the end of which are chamfered. Similarly, the body portion 14 is also substantially U-shaped with it legs 14*a* and 14*b* also being chamfered. It is understood that the internal surfaces of the body portions 12 and 14 are machined to form an aerodynamic design and, as such, have different internal configurations. The internal surfaces of the body portions 12 and 14 are also configured to provide a transition from a substantially rectangular cross-section to a substantially circular cross-section for reasons that will be explained.

Figure 2:
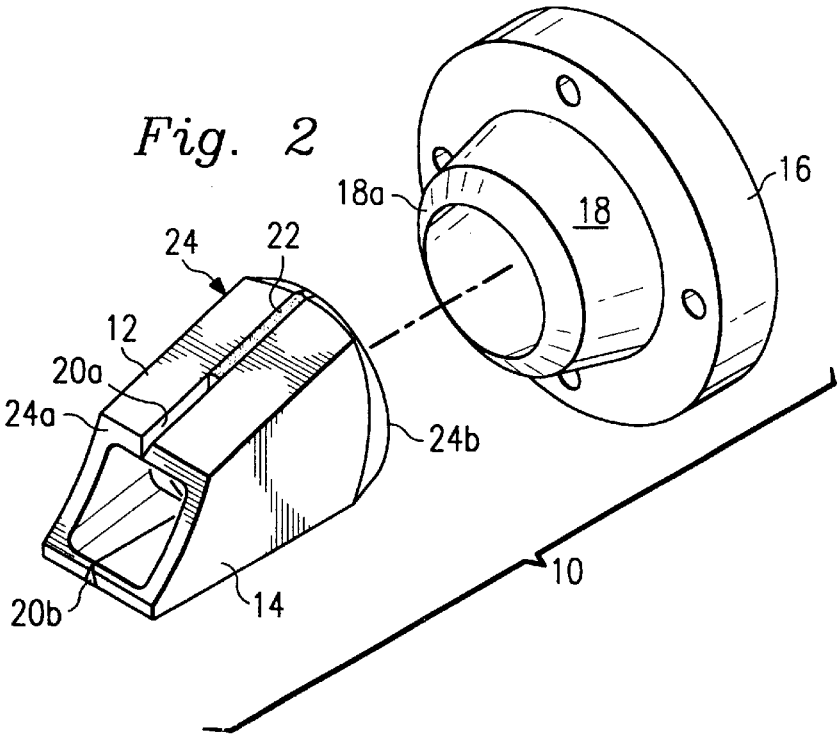
FIG. 2 is a view similar to FIG. 1 but depicting a manufacturing step according to the method of the present invention.

The body portions 12 and 14 are connected together by placing the chamfered ends of the legs 12*a* and 12*b* of the body portion 12 in abutment with the chamfered ends of the legs 14*a* and 14*b*, respectively, of the body portion 14 as shown in FIG. 2. In this position, the chamfered ends of the legs 12*a* and 14*a* form a weld prep, or groove 20*a*, and the chamfered ends of the legs 12*b* and 14*b* form a groove 20*b*. The body portions 12 and 14 are welded together by welding a standard welding material, a portion of which is shown by the reference numeral 22, into the grooves 20*a* and 20*b* in a conventional manner to form a housing 24 having two ends 24*a* and 24*b* each of which are open.

The end 24*a* of the housing 24 has a rectangular cross-section and the end 24*b* has a circular cross-section and is chamfered. The internal surfaces of the housing members 12 and 14, and therefore the housing 24, are machined to provide a predetermined aerodynamic design and a gradual transition between the rectangular cross-section at the end 24*a* and the circular cross-section and the end 24*b*.

Figure 3:
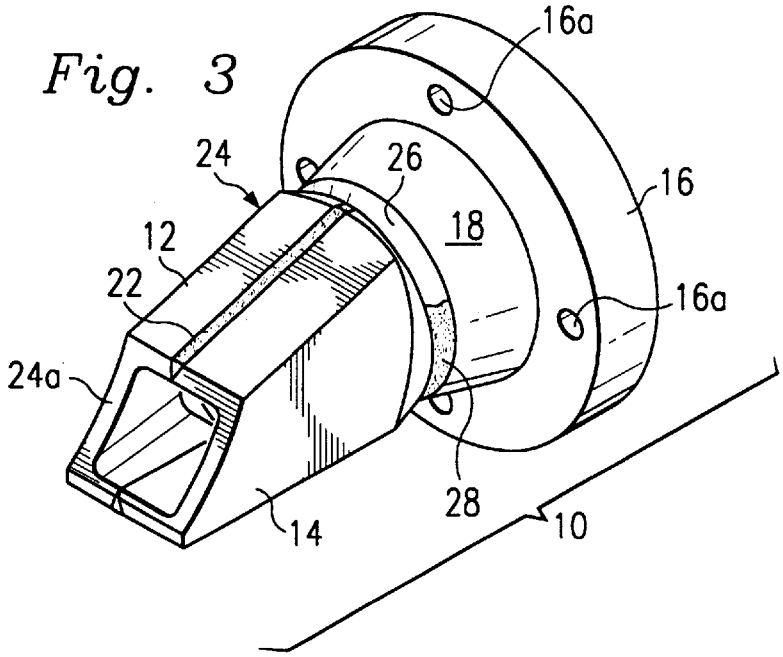
FIG. 3 is a view similar to FIGS. 1 and 2, but depicting the nozzle assembly in its fully assembled condition.

The housing 24 is connected to the mounting member 18 of the flange 16 in a manner depicted in FIG. 3. More particularly, the chamfered end 24*b* of the housing 24 is placed in abutment with the chamfered end 18*a* of the mounting member 18 so that the abutting ends define a weld prep, or groove 26 which receives a standard welding material, a portion of which is shown by the reference numeral 28, to complete the assembly of the nozzle assembly 10.

Figure 4:
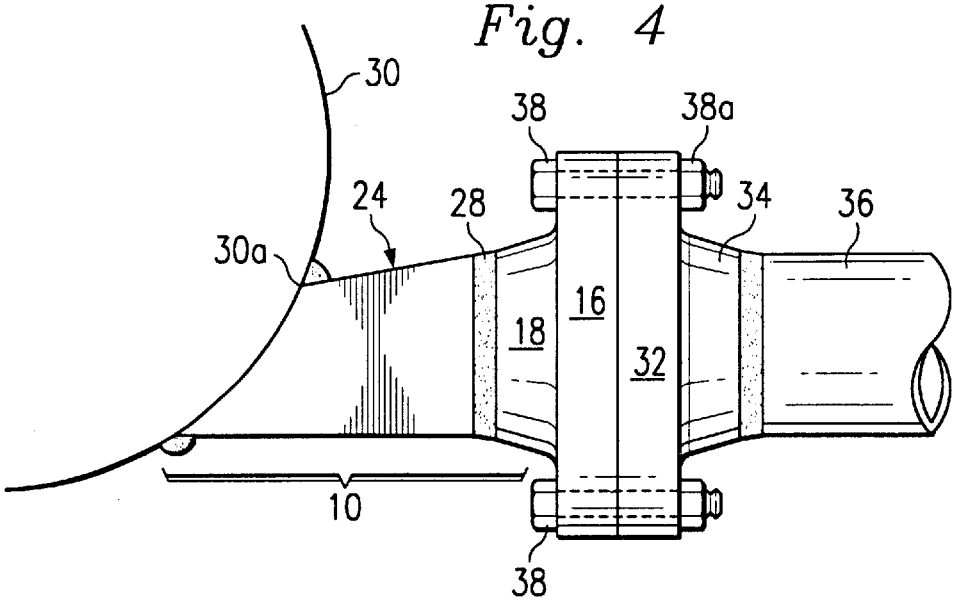
FIG. 4 is a front elevational view of the nozzle assembly of FIG. 3 shown mounted between a turbomachine casing and a conduit.

The nozzle assembly 10 is depicted in FIG. 4 connected to the case 30 of a turbomachine, or the like. To this end, the end 24*a* of the assembly 10 is welded to the case 30 so that it extends around an outlet opening 30*a* in the case.

An annular neck flange 32 is provided that is identical to the flange 16 and has a frusto-conical mounting member 34 extending from one end thereof which is identical to the mounting member 18. The mounting member 34 can be formed integrally with the flange 32 or it can be connected to the flange in any known manner. The flange 32 and the member 34 are coaxially disposed and together define a through bore. A conduit 36 is welded to the mounting member 34 in the same manner as described above in connecting with welding the enclosure 24 to the mounting member 18.

A plurality of angularly-spaced openings 16*a* are machined through the flange 16 as better shown in FIG. 3 and a plurality of similar opening are machined through the flange 32. The flanges 16 and 32 are placed together so that their corresponding faces abut as shown in FIG. 4. In this position the openings 16*a* in the flange align with the openings in the flange 32 and a plurality of bolts 38 are inserted through the aligned openings and secured with nuts 38*a*, to connect the flange 18 to the flange 32, and therefore the conduit 36 to the nozzle assembly 10. Therefore, fluids exiting the case 30 through the outlet opening 30*a* pass through the nozzle assembly 10 and the conduit 30 for further treatment.

Several advantages are gained by the assembly and method of the present invention. For example, the nozzle assembly can be manufactured quickly and easily and is relatively inexpensive.

It is understood that variations may be made in the foregoing without departing from the scope of the present invention. For example, the specific shape of the body portions 12 and 14, and therefore the housing 24, can be varied within the scope of the invention.

It is understood that other modifications, changes and substitutions are intended in the foregoing disclosure and in some instances some features of the invention will be employed without a corresponding use of other features. Also the components discussed above can be connected together other than by welding. Accordingly, it is appropriate that the appended claims be construed broadly and in a manner consistent with the scope of the invention.

What is claimed is:

1. A method of manufacturing a nozzle assembly comprising machining a body member so that it has a substantially U-shaped cross-section with two spaced legs, so that one of its ends forms a portion of a rectangle in cross-section, and so that the other of its ends is semi-circular in cross-section; machining another body member so that it has a substantially U-shaped cross-section with two spaced legs, so that one of its ends forms a portion of a rectangle in cross-section, and so that the other of its ends is semi-circular in cross-section; and connecting the legs of one body member to the corresponding legs of the other body member so that a hollow enclosure is formed, one end of which is rectangular in cross-section for connection to a casing, and the other end of which is circular in cross-section for connection to a mounting member having a circular cross-section.

2. The method of claim 1 wherein the casing is substantially spherical in shape and wherein the one end of the enclosure is curved to accommodate the spherical casing.

3. The method of claim 1 wherein the step of connecting comprises chamfering the respective ends of the legs of each body member, placing the chamfered ends of the legs of the first body member in abutment with the corresponding chamfered ends of the legs of the second body member, and welding the corresponding legs together.

4. The method of claim 1 further comprising chamfering the one end of the enclosure so that it can be welded to the casing.

5. The method of claim 1 further comprising chamfering the other end of the enclosure so that it can be welded to the mounting member.

* * * * *